US005149219A

United States Patent [19]

Kageyama et al.

[11] Patent Number: 5,149,219

[45] Date of Patent: * Sep. 22, 1992

[54] SWING-TYPE MECHANICAL PENCIL

[75] Inventors: Shuhei Kageyama; Takahiko Suzuki; Yuichi Yamagishi, all of Kawagoeshi, Japan

[73] Assignee: Kotobuki & Co., Ltd., Kyoto, Japan

[ * ] Notice: The portion of the term of this patent subsequent to May 29, 2007 has been disclaimed.

[21] Appl. No.: 520,636

[22] Filed: May 8, 1990

Related U.S. Application Data

[62] Division of Ser. No. 203,784, Jun. 7, 1988, Pat. No. 4,929,107.

[30] Foreign Application Priority Data

| | | | |
|---|---|---|---|
| Jun. 12, 1987 | [JP] | Japan | 62-90663 |
| Jul. 31, 1987 | [JP] | Japan | 62-117960 |
| Oct. 14, 1987 | [JP] | Japan | 62-157740 |
| Mar. 18, 1988 | [JP] | Japan | 63-36964 |

[51] Int. Cl.[5] ..... B43K 21/02; B43K 21/06; B43K 24/04

[52] U.S. Cl. ..... 401/65; 401/83; 401/115

[58] Field of Search ..... 401/65, 67, 53, 55, 401/56, 57, 82, 83, 115, 84

[56] References Cited

U.S. PATENT DOCUMENTS

| | | | |
|---|---|---|---|
| 2,520,796 | 8/1950 | Bouhier | 401/65 X |
| 4,205,924 | 6/1980 | Sumita | 401/67 X |

*Primary Examiner*—Danton D. DeMille
*Attorney, Agent, or Firm*—David O'Reilly

[57] ABSTRACT

The present invention relates to a swing-type mechanical pencil wherein lead can be extended from a head member connected to an outer sleeve by swinging the outer sleeve to move a knocking hammer. The knocking hammer applies a lead-feeding action to feed the lead. A chuck shutting hammer is mounted between a spring bearing of a chuck ring sleeve retaining a chuck ring which is a component of the lead holder and a second spring connected with the chuck. An upward movement of the chuck shutting hammer forces the chuck into a chuck ring. This provides a positive action to shut the chuck preventing slipping of the lead when writing with the mechanical pencil. Manual advance of lead is provided by a slider in a recession an outer surface of the sleeve that engages the lead holder allowing the chuck to be manually opened to extend lead.

5 Claims, 10 Drawing Sheets 101
102
103
104
105
106
108
109
110
111
114
114'
116
120
121
122
123
124
201
208
210
211
212

SWING-TYPE MECHANICAL PENCIL

CROSS-REFERENCE TO RELATED APPLICATION

This is a division of applicant's co-pending U.S. patent application Ser. No. 07/203,784, filed Jun. 7, 1988 now U.S. Pat. No. 4,929,107.

FIELD OF THE INVENTION

This invention relates to a mechanical pencil wherein lead can be extended by a given length from a head member which is connected with an outer sleeve by swinging the swing-type mechanical pencil wherein the lead can be extended for the outer sleeve by swinging the outer sleeve so that a knocking hammer can act on the lead-feeding mechanism.

BACKGROUND OF THE INVENTION

Referring to the drawings, known mechanical pencils, similar to that shown in FIG. 1 are constructed so that knocking hammer 3 is moved up and down by swinging or shaking the outer sleeve 1. A chuck 4, part of lead holder 2 is opened or shut against the force of chuck-clamping spring 5 by moving the knocking hammer 3 up and down so that lead can be extended by a given length from a head member 6 connected with the outer sleeve 1. In the above known construction, the spring force of chuck-clamping spring 5 is weakened, because if the spring force is too strong, opening of the chuck by knocking hammer 3 cannot be efficiently or positively performed. However, when the spring force is weak, allowing the opening operation to be successfully performed the shutting operation of the chuck cannot be efficiently performed, so that slipping of the lead can occur when writing. Thus writing with this type of mechanical pencil can be difficult.

Another known mechanical swing-type mechanical pencil similar to the embodiment of FIG. 2 has a knocking hammer 111 reciprocated in an axial direction by softly swinging the pencil sleeve 108 knocking lead holding pipe 101 of lead feeding mechanism 107 so that chuck 102 can open or shut.

Chuck 102 inserted in chuck ring 103 is retained on the forward end of chuck ring bearing sleeve 104, inserted in the lead pipe through a chuck coupling and can be moved against the force of a chuck clamping springly by the above-mentioned knocking, to open chuck 104 so that lead can be extended from a head member 109.

However, in the above-mentioned known constructions, lead pipe 101 is provided with a stopper and with a chuck coupling contacts the forward and rear ends of the knocking hammer 111 to restrain the scope of movement of the knocking hammer. The inside of the outer sleeve 108 is provided with a stopper on the outer sleeve retaining a stopper on the pipe to limit the scope of the movement of knocking hammer 111. A total of three parts of a chuck coupling and stoppers on the pipe and on the outer sleeve are required. This is a problem because the construction is complicated, and assembly is not easy.

Still another swing-type mechanical pencil, similar to FIG. 5 has knocking hammer 202 reciprocating (up and down) in an axial direction by swinging an outer sleeve 201 to knock lead case 205 of lead-feeding mechanism 203. Chuck 19 inserted in chuck ring 218 retained on the forward portion of chuck ring bearing sleeve 217, sets the forward end portion of lead case 205 and can be moved against the spring force of a chuck-clamping spring 220 by the above-mentioned knocking, so the chuck can be opened or shut. Thereby, lead can be fed by a given length from chuck 219, and be sent out from head pipe 223 of guide 222 in the forward end portion of the head member 221 attached to outer sleeve 201.

Further, lead 204 can be drawn, together with the head pipe 223, into head member 221 by pushing the end of the lead while maintaining an opened state of chuck 219. It is possible to extend lead by pushing lead case 205 by knocking its rear end.

However, in the above-mentioned construction a retaining part for restraining knocking hammer 202 from moving upward is needed besides a projecting part 224 serving also as a bearing for spring 220 at the outer surface of lead case 205. Because lead case 205 can be knocked by knocking hammer 202 moving upward, there is a problem of an unexpected extension of lead performed by the upward and downward movement of the outer member caused by the mechanical pencil being vibrated while being carried.

In known swing-type mechanical pencils similar to that shown in FIG. 9, a knocking hammer 302 can be reciprocated (moved up and down) in an axial direction by swinging outer sleeve 301 and knocking lead case 305 of lead-feeding mechanism 303. Chuck 319 inserted in chuck ring 318 is retained on the forward portion of chuck ring bearing sleeve 317, set in the forward end portion of lead case 305 and can be moved against the spring force of a chuck-clamping spring 320 by the above-mentioned knocking. The chuck can thereby be opened or shut, and lead fed by a given length from chuck 319, and extended from head pipe 823 of slider guide 322 in the forward end portion of head member 321 attached to outer sleeve 301.

Further, lead 304 can be drawn with the head pipe Into head member 321 by pushing the end of the lead while maintaining an opened position of chuck 319. It is also possible to extend lead by pushing on lead case 305 by knocking the rear end.

However, in the above-mentioned known construction there is the problem of lead being positively held, as it does not have a construction allowing upward movement of hammer 302 to male lead case 305 move up compulsorily to shut chuck 319. Further, as lead case 305 is knocked by upward and downward movement of the knocking hammer, there is another problem of an expected extension of lead caused by the upward and downward vibration of the pencil while being carried.

BRIEF DESCRIPTION OF THE INVENTION

This invention intends to eliminate the above drawbacks, and it is an object of this invention to provide a mechanical pencil wherein lead holder 2 is mounted in an outer sleeve 1. A knocking hammer 3 is moved up and down by swinging outer sleeve 1. A chuck 4, a component of lead holder 2 is opened or shut against a chuck-clamping spring 5 or by the force of the spring by moving knocking hammer 3 up and down, so that lead can be extended by a given length from head member 6 connected with outer sleeve 1. According to the present device chuck-shutting hammer 11 is mounted between spring bearing 9 of chuck ring sleeve 8 retaining chuck ring 7 a component of lead holder 2. A second spring 10 is connected to chuck 4. As the outer sleeve 1 is swung up and down, knocking hammer 3 moves up and down.

The upward or downward movement of knocking hammer 3 makes chuck 4, of lead holder 2, open or shut against the force of chuck-clamping spring 5 or by the force of the spring through spring bearing 10 connected with chuck 4. When chuck 4 returns (moves upwards) by the action of the spring force of chuck-clamping spring 5, chuck-shutting hammer 11 moves up to knock against spring bearing 10, and makes chuck 4, connected with spring bearing 10, move up compulsorily in association with the spring force of chuck-clamping force 5 so that the chuck is inserted in chuck ring 7. Thus the shutting operation of chuck 4 is positively performed so that the lead is firmly engaged by chuck 4. Therefore, slipping of lead does not occur when writing with the mechanical pencil. As above-mentioned, because chuck-shutting hammer 11 is mounted between spring bearing 9 of chuck ring sleeve 8 that retains chuck ring 7, a component of lead holder 2, and second spring bearing 10 connected with chuck 4, chuck-shutting hammer 11 is moved up or down simultaneously with the upward and downward movement of knocking hammer 3. However, the upward movement of chuck-shutting hammer 11 makes chuck 4 compulsorily insert in chuck ring 7. Therefore because the chuck can be positively shut, slipping of the lead does not occur, and writing with the mechanical pencil can be positively performed.

The other object of this invention is to provide a swing-type mechanical pencil which comprises lead-feeding mechanism 107 having a chuck 102 inserted in lead pipe 101, chuck ring 103 on chuck 102, chuck ring bearing sleeve 104 retaining chuck ring 103, and chuck-clamping elastic body 106 inserted between sleeve 104 and receiving part 105 provided on the lead pipe. Sleeve 104 is attached to head member 109 connected with outer sleeve 108 and lead-feeding mechanism 107 is inserted in outer sleeve 108. A knocking hammer 111 is inserted between receiving part 105 and knocking part 110 attached to lead pipe 101. When outer sleeve 108 is swung up and down, knocking hammer 111 is reciprocated between the receiving part 105 provided on lead pipe 101 and knocking part 110 attached to lead pipe 101. The reciprocating movement of knocking hammer 111 knocks on receiving part 105, and makes chuck 102 inserted in chuck ring 103 move against the elasticity of chuck-clamping elastic body 106 or by the elasticity thereof, so the chuck can be opened or shut, and lead 115 extended by a given length from head member 109. When lead 115 is drawn in, knocking part 110 is pushed. The movement of knocking part 110 makes chuck 102 move forward against the elasticity of chuck-clamping body 106 so that the chuck can be opened. Withdrawing of lead is performed by pushing the tip of the lead while maintaining the chuck in an open state. As previously mentioned, the travelling scope of knocking hammer 111 is determined by receiving part 105 and knocking part 110 having receiving part 112. Therefore, the number of parts necessary can be reduced to one or two parts; the construction is simple, assembly is easy, and the pencil is low-priced.

Another object of this invention is to provide a swing-type mechanical pencil wherein lead 204 can be extended from the head of an outer sleeve 201 by swinging outer sleeve 201 so that a knocking hammer 202 acts on a lead-feeding mechanism 203. According to the present device, a lead case bearing 206 is connected to the rear end portion of a lead case 205 of lead-feeding mechanism 203. A hole 207 is provided in a side portion of lead case bearing 206 while an axial slit 208 is provided in the area of the outer sleeve facing hole 207. A long hole 210 for slider 209 is formed in a part of outer sleeve 201 enclosing slit 208. The slit 208 is formed with a neck portion 212 which makes projecting part 211 travel step by step when projecting part 211 of slider 209 is inserted in hole 207 through slit 208 and slider 209 is retracted. When outer sleeve 1 is swung, knocking hammer 202 moves up and down to act on lead-feeding mechanisms 203. As a result of knocking hammer 202 knocking lead case 205, lead 204 is extended from the head end of outer sleeve 201. In this case, projecting part 211 of slider 209 is inserted in hole 207 formed in lead case bearing 206, and slider 209 is retained in neck portion 212 provided in outer sleeve 201, preventing the hammer from moving upward.

Further, when slider 209 is moved forward and backward along slit 208, lead 204 is extended from the head end of outer sleeve 201 by pushing lead case 205 of lead-feeding mechanism 203 through lead case bearing 206 by a forward and backward movement of slider 209 in the same manner as in known mechanical pencils, since projecting part 21 of slider 209 is in hole 207 of lead case bearing 206.

In order to withdraw lead 204, lead, case 205 is pushed by lead case bearing 206 having projecting part 211 of slider 209 inserted in hole 207. By moving it forward chuck 219 of lead-feeding mechanism 203 is kept open, and lead can be drawn into the head end of outer sleeve 201 by pushing the tip of the lead while keeping chuck 219 open in the same manner as in the known mechanical pencils.

When the pencil is being carried, projecting part 211 of slider 209 is secured between neck portion 212 at the rear end of slit 208 by pushing slider 209 backward compulsorily forcing it through neck portion 212 so that the slider is locked. Lead case bearing 206 receiving projecting part 211 of slider 209 in hole 207 and lead case 205 connected thereto are thereby locked with slider 209. Therefore, though an upward and downward movement of outer sleeve 201 makes knocking hammer 203 move up and down, the lead-feeding action of lead-feeding mechanism 203 in prevented. According to the device, upward movement of knocking hammer 202 can be restrained without another retaining part; particularly when carrying the mechanical pencil and projecting part 211 of slider 208 is secured in neck portion 212 and rear end of slit 208 by pushing slider 209 backward so the slider is locked. Lead case bearing 206 receiving projecting part 211 of slider 209 in hole 207 and lead case 205 connected thereto are thereby locked with slider 209. Therefore, the upward and downward movement of outer sleeve 210 makes knocking hammer 203 move up and down, does not cause a the lead-feeding action of lead-feeding mechanism 203.

Still another object of this invention is to provide a swing-type mechanical pencil Wherein lead 304 is extended from the head of outer sleeve 301 by swinging the outer sleeve so that knocking hammer 302 acts on lead-feeding mechanism 303. According to the device, an axial slit on the side of case 306, struck part 307 being struck by knocking hammer 302 and a clinching part 308 behind said struck part 307 are provided at the rear portion of lead case 305 of lead-feeding mechanism 303. Lead case bearing 310 has a projection 309 connected to the rear portion of lead case 305 between struck part 307 and clinching part 308 at the rear portion of the lead case. Hole 307 is provided in a side portion of lead case bearing 310, while an axial slit on outer sleeve side 312 is provided in the area of outer sleeve hole 311. Long hole 314 for slider 313 is formed in a part of outer sleeve 301 surrounding the slit on outer sleeve side 312. Projecting part 315 of slider 313 is inserted in hole 311 through the slit on outer sleeve 312. When outer sleeve 301 is swung, knocking hammer 302 moves up and down to act on the lead-feeding mechanism to knock the lead case so that lead 304 is extended from the head end of the outer sleeve When struck part 307 is struck by upwardly moving knocking hammer 302 the lead case is moved slightly upwards until slider 313, having projecting part 315 inserted in hole 311 of lead case bearing 310 is connected to lead case 305. As a result, chuck 319 is positively closed to prevent the lead from slipping.

When slider 313 is moved forward and backward along the slit on outer sleeve side 312, lead 304 is extended from the head end of outer sleeve 301 by pushing lead case 305 of lead-mechanism 303 through lead case bearing 310 in the same manner as in known mechanical pencils. Because projecting part 315 of slider 313 is inserted in hole 313 of lead case bearing 310 In order to draw lead 304 in, lead case 305 is pushed through lead case bearing 313 by projecting part 315 of slider 313 inserted in hole 313, moving forward so that chuck 319 of lead-feeding mechanism 303 is kept in an opened state. Lead 304 can then be drawn into the head end of outer sleeve 301 by pushing on the tip of the lead while maintaining an opened state in the same manner as in known mechanical pencils. When carrying the mechanical pencil, projecting part 315 on slider 313 is inserted between neck portion 312*a* provided on outer sleeve side 312 in the rear end of slit 308, by pushing slider 313 backward to compulsorily pass through neck portion 312*a* so that slider 313 is locked. Thereby lead case bearing 310, receiving projecting part 315 of slider 313 in hole 311, and lead case 305 connected thereto are locked with slider 313. Therefore, though the upward and downward movement of outer sleeve 301 makes knocking hammer 303 move up and down, the lead-feeding action of lead-feeding mechanism 303 does not occur. As is evident from the above-explanation, struck part 307 is knocked by upward moving knocking hammer 302 so that lead case 305 is moved upwards a little until slider 313, having projecting part 315 inserted in hole 311 of lead case bearing 310 connected to lead case 305, is retained. As a result, chuck 319 is compulsorily inserted in chuck ring 318 and shut, which results in positively gripping lead 304 preventing the lead from slipping when writing. When carrying the mechanical pencil, projecting part 315 of slider 313 is inserted between neck portion 312*a* at the rear end of the slit on outer sleeve side 312 by pushing slider 313 backward and compulsorily passing through neck portion 312*a* in the slit on outer sleeve side 312 so that slider 313 is locked. Thereby lead case bearing 310, receiving projecting part 315 of slider 313 in hole 311, and lead case 305 connected thereto, are locked with slider 313. Therefore, though the upward and downward movement of outer sleeve 301 makes knocking hammer 303 move up and down, the lead-feeding action of lead-feeding mechanism 303 cannot occur.

The above and other objects, advantages and novel features of this invention will be more fully understood from the following detailed description and the accompanying drawings, in which like reference numbers indicate like or similar parts throughout, wherein;

DETAILED DESCRIPTION OF THE INVENTION

Figure 1:
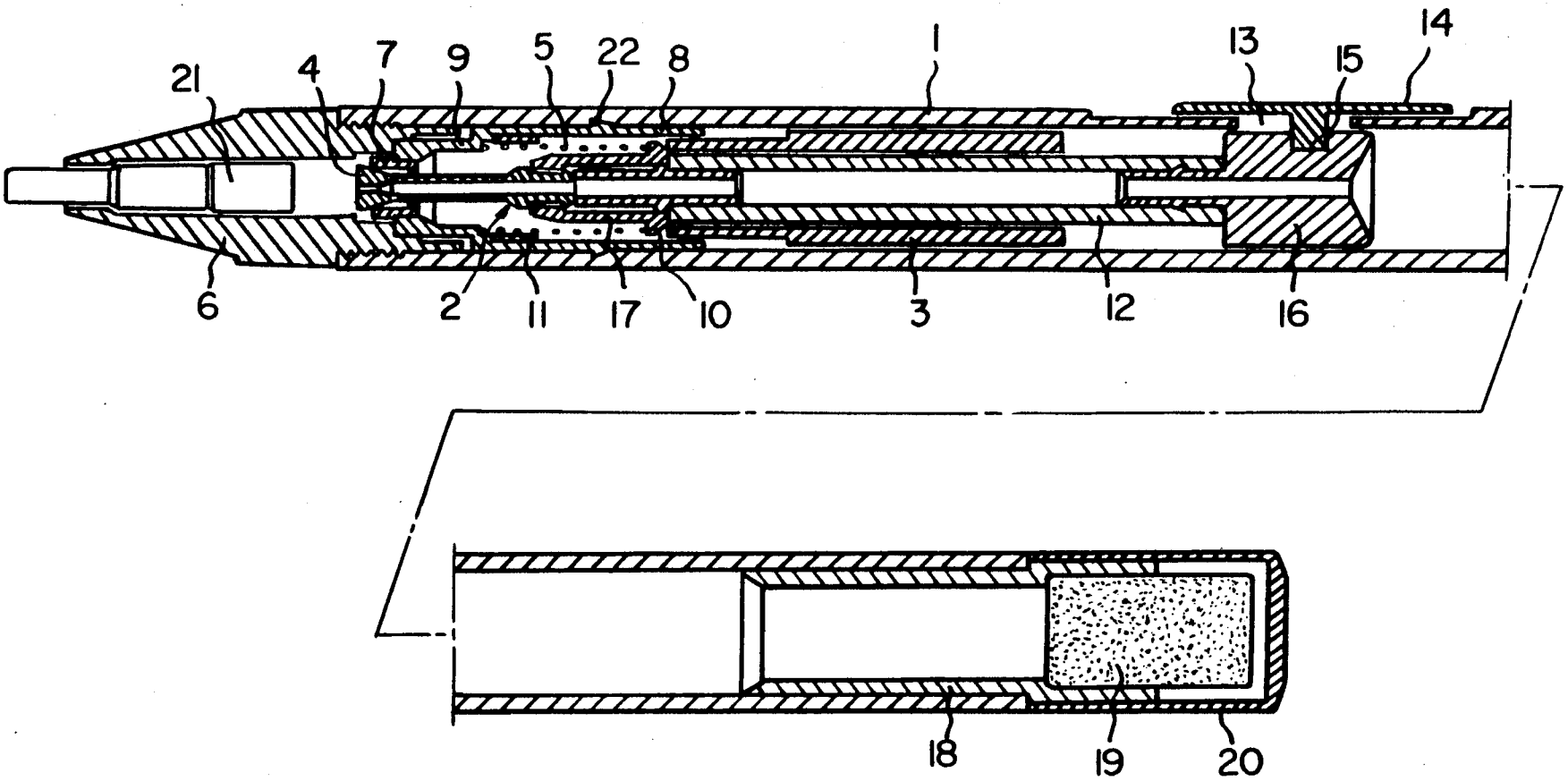
FIG. 1 is a sectional view of a first embodiment of a mechanical pencil according to the invention.

Referring now to the drawings, an embodiment according to the present invention will be described.

FIG. 1 is a sectional view showing a first embodiment of a mechanical pencil of this invention.

In the drawing, of FIG. 1 a lead holder 2 mounted in the outer sleeve 1. Lead holder 2 includes a lead pipe 12. Chuck coupling 17 is mounted on to the forward end of lead pipe 12, and has a spring bearing 10 at the rear portion thereof. Chuck 4 is connected to the forward portion of chuck bearing 17, engaging the chuck with the forward portion of the chuck bearing. Chuck ring 7 is fitted on chuck 4. Chuck ring sleeve 8 retains the rear portion of chuck ring 7. Spring bearing 9 is provided adjacent said chuck ring sleeve 8. Chuck-clamping spring 5 is provided between said spring bearing 9 and spring bearing shoulder 10 of chuck coupling 17.

Between spring bearing 9 of chuck ring spring 8 and the spring bearing shoulder 10 of chuck coupling 17, connected with chuck 4, chuck-shutting hammer 11 coaxially positioned with chuck-clamping spring 5.

Further, controlling body 16 is inserted in the rear portion of lead pipe 12. A portion of outer sleeve 1 facing controlling body 16 has an axial guide hole 13. Through guide hole 13, base 15 of slide-controlling part 14 is attached to controlling body 16 by insertion, sealing, engagement, or the like. The rear portion of lead pipe 12 may be an integral part of controlling body 16.

An outer surface portion of outer sleeve 1 on which slide-controlling part 14 can slide is formed so that the outer surface of outer sleeve 1 can be flush with slide controlling part 14.

Eraser holder 18 is firmly inserted in the rear end of outer sleeve 1. Eraser cap 20 is softly put on eraser 19 set in eraser holder 18.

Further, the area of the outer sleeve between controlling body 16 and eraser holder 18 is formed as a lead tank. Head member 6 is screwed on the forward end of outer sleeve 1. Guide 21 provides a lead-holding function. It provides a lead guiding function and its forward end projects from head member 6 by forward movement of chuck 4. It is freely fitted in head member 6.

In the above construction, when outer sleeve 1 is swung up and down, knocking hammer 3 moves up and down between the spring bearing 10 and controlling body 16. The upward and downward movement of knocking hammer 3 makes chuck 4, a component of lead holder 2, open of shut against chuck-clamping spring 5 or by the spring force of said spring on spring bearing 10 of chuck coupling 17 connected with the chuck. The opening or shutting action of chuck 4, caused lead to extended by a given length through guide 21 in said head member 6 from the forward end of guide 21.

Further, simultaneously with the upward and downward movement of knocking hammer 3, chuck-shutting hammer 11 moves up and down between spring bearing 9 of chuck ring sleeve 8 and spring bearing 10 of chuck coupling 17. When chuck 4 returns (moves upward) by the action of the spring force of chuck-clamping spring 5, chuck-shutting hammer 11 moves up to knock spring bearing 10, and compulsorily makes chuck 4 move up through chuck coupling 17 having spring bearing 10, so that the chuck is compulsorily inserted in chuck ring 7, whereby the shutting operation of chuck 4 is sufficient so that lead can be firmly gripped by the chuck. Therefore as slipping of the lead cannot occur when writing with the mechanical pencil, writing can be smoothly accomplished.

Extension of the lead can also be performed by sliding control of slide-controlling part 14. That is, when slide-controlling part 14 slides in the front or rear direction, both controlling body 16, attached to slide-controlling part 14 and lead pipe 12, are moved in the forward or rear direction. Thereby both chuck coupling 17 having spring bearing 10 and chuck 4 are opened or shut against the spring force of chuck-clamping spring 5 so that lead can be extended by a given length from the forward end of guide 21.

Drawing lead into the head member is possible by sliding slide-controlling part 14 in a forward direction to open chuck 4, and pushing on the tip of the lead with maintaining the above condition.

Further, the location of chuck ring sleeve 8 can be easily and precisely arranged because chuck ring sleeve 8 has a hook-shaped part 22 on the outer surface engaging the forward end of outer sleeve 1. Screwing head member 6 in the forward end portion of outer sleeve 1 pushes the chuck ring sleeve with the rear end of head member 6 until it comes into contact with the forward end of outer sleeve 1. Therefore variations of the amount of lead-feeding can be prevented.

As above mentioned, chuck-shutting hammer 11 is mounted between spring bearing 9 of chuck ring sleeve 8 retaining chuck ring 7, a component of lead holder 2, and a second spring bearing 10 connected with chuck 4. Chuck-shutting hammer 11 moves up or down, simultaneously with the upward and downward movement of knocking hammer 3. The upward movement of chuck-shutting hammer 11 makes chuck 4 compulsorily engage chuck ring 7. Therefore as the chuck can be positively shut, slipping of lead does not occur when writing with the mechanical pencil.

Figure 2:
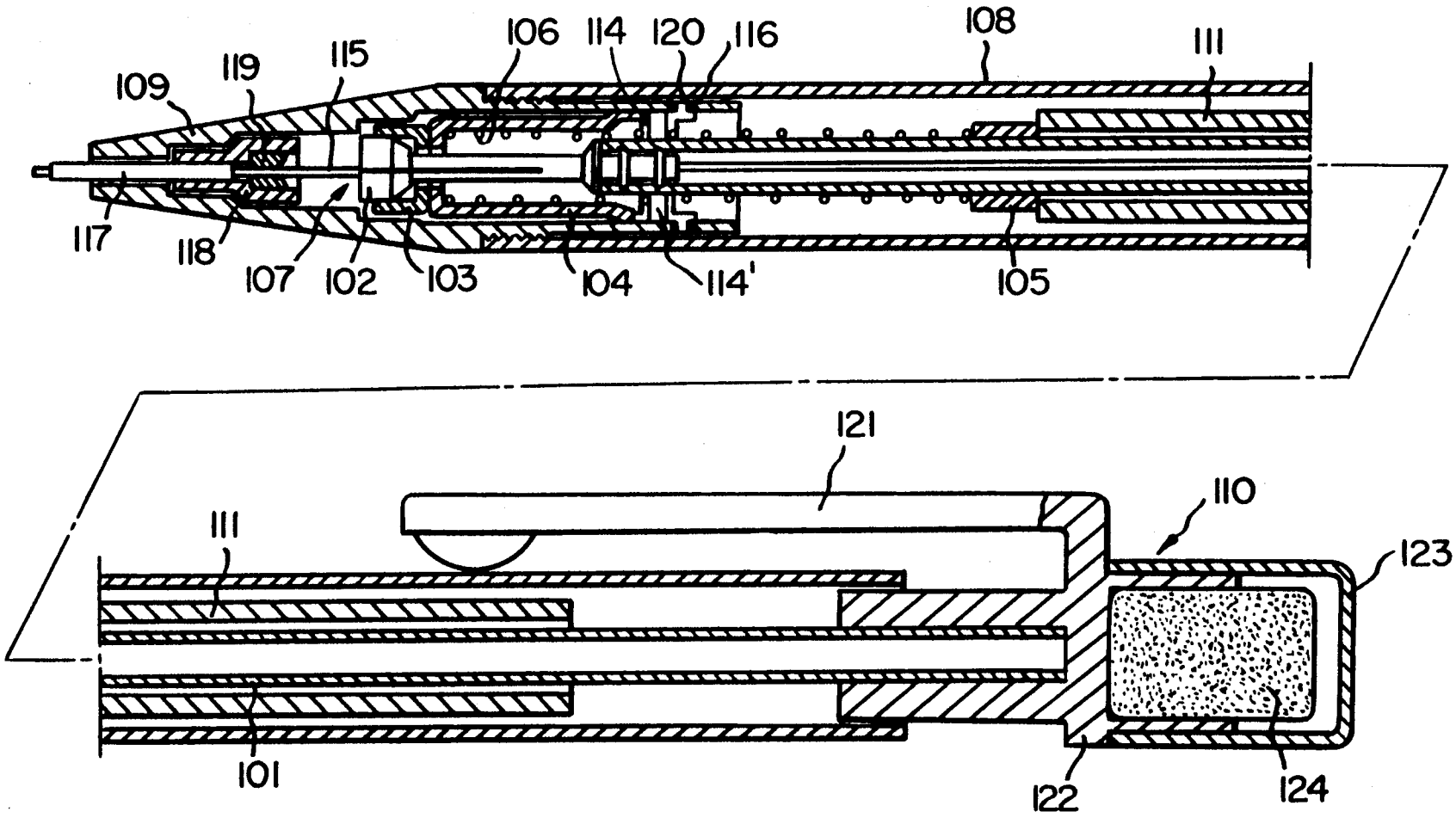
FIG. 2 is a longitudinal sectional view showing the second embodiment of a swing-type mechanical pencil according to the invention.
Figures 3, 6:
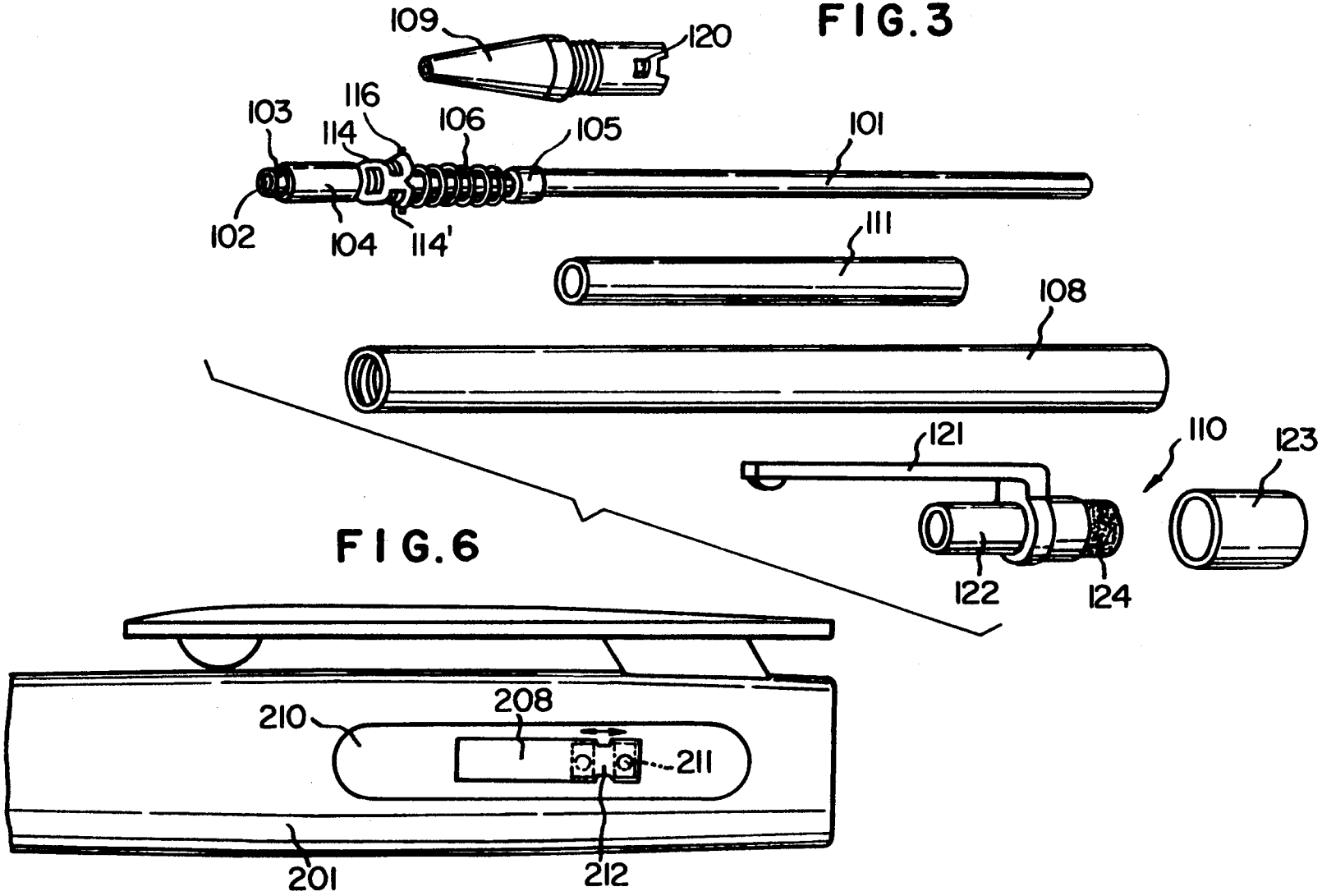
FIG. 3 is a partially exploded perspective view of the second embodiment.
FIG. 6 is a side view showing a portion of an outer sleeve of the fourth embodiment.

FIG. 2 is a longitudinal sectional view showing a second embodiment of a swing-type mechanical pencil according to the present invention, and FIG. 3 is a partially exploded perspective view of the second embodiment.

In FIG. 2, a lead pipe 101, receives leads. Chuck 102 us fitted in lead pipe 101. Chuck ring 103 is put on the chuck 102. Chuck ring bearing sleeve 104 retains chuck ring 103. Receiving part 105 is provided at a forward part of lead pipe 101 by press fit engagement. Chuck-clamping spring 106 is inserted between sleeve 104 and receiving part 105 of lead pipe 101.

Lead-feeding mechanism 107 is comprised of lead pipe 101, chuck 102, chuck ring 103, chuck ring bearing sleeve 104 and chuck-clamping spring 106. Behind chuck ring bearing sleeve 104, a buffering elastic body 114 having buffering spaces 114' is formed. Projections 116 are provided on an outer surface of rear portion of buffering elastic body 114. The number of these projections is optional and a desired number is ordinarily over 2.

Head member 109, receives a head pipe 117 set at the forward end portion of head member 109. Guide 118 having packing 119 attached for holding lead is provided adjacent to the inner surface of the rear portion of the head. At the rear part of head member 109, small holes 120 for receiving projections 116 are provided. Chuck ring bearing sleeve 104 is retained on the head member by inserting projections 116 in small holes 120, allowing the head member and lead-feeding mechanism 107 to be held together as one body.

Lead feeding mechanism 107 is mounted In outer sleeve 108, and outer sleeve 108 and head member 109 are connected by means of a screw and the like. Lead pipe 101 is inserted in knocking hammer 111. Knocking part 110 including clip 121 and eraser holder 112 are put in the rear part of lead pipe 101.

Cap 123 is put on eraser 124. Attachment of knocking part 110 is accomplished in a manner that allows removal of the knocking part from lead pipe 101 for replenishment of lead without knocking part 110 getting out of lead pipe 101 when knocking hammer 111 is pressed against knocking part 110. Of course, knocking part 110 may be attached to lead pipe 101 by screwing the former to the latter. In short, any means can be applied that makes removal of knocking part 120 possible that prevents knocking part 210 from getting out of the lead pipe.

In the first example, when outer sleeve 108 is swung up and down, knocking hammer 111 is reciprocated between receiving part 105 provided on lead pipe 1 and knocking pipe 110 inserted in lead pipe 101. Knocking hammer 111 knocks receiving part 105 causing chuck 102 inserted in chuck ring 103 to move against or with the spring force of chuck-clamping spring 106 so that the chuck can open or shut, and lead 115 can be extended by a given length from head member 109.

To draw lead 115 in, knocking part 110 is pushed, so that chuck 102 inserted in lead pipe 1 moves forward against the spring force of the chuck-clamping spring allowing lead to be drawn in by pushing on the tip of lead while maintaining an open state.

Further, whether the knocking hammer is removed or not, the swing-type mechanical pencil according to the present device can be used as a normal knock-type mechanical pencil. That is, knocking of knocking part 110 makes chuck 102 move against or with the spring force of the chuck-clamping spring so that chuck 102 can be opened or shut and lead can be extended from head member 109. In this case, the spring force of spring 106 is relatively weak, since the spring force allows lead-feeding by means of knocking hammer 111 easy. Therefore, the knocking operation can be performed easily.

Further, when buffering elastic body 114 is provided on sleeve 104, the rate of lead-breaking can be reduced because excessive power of the pencil is absorbed by the buffering elastic body.

Figure 4:
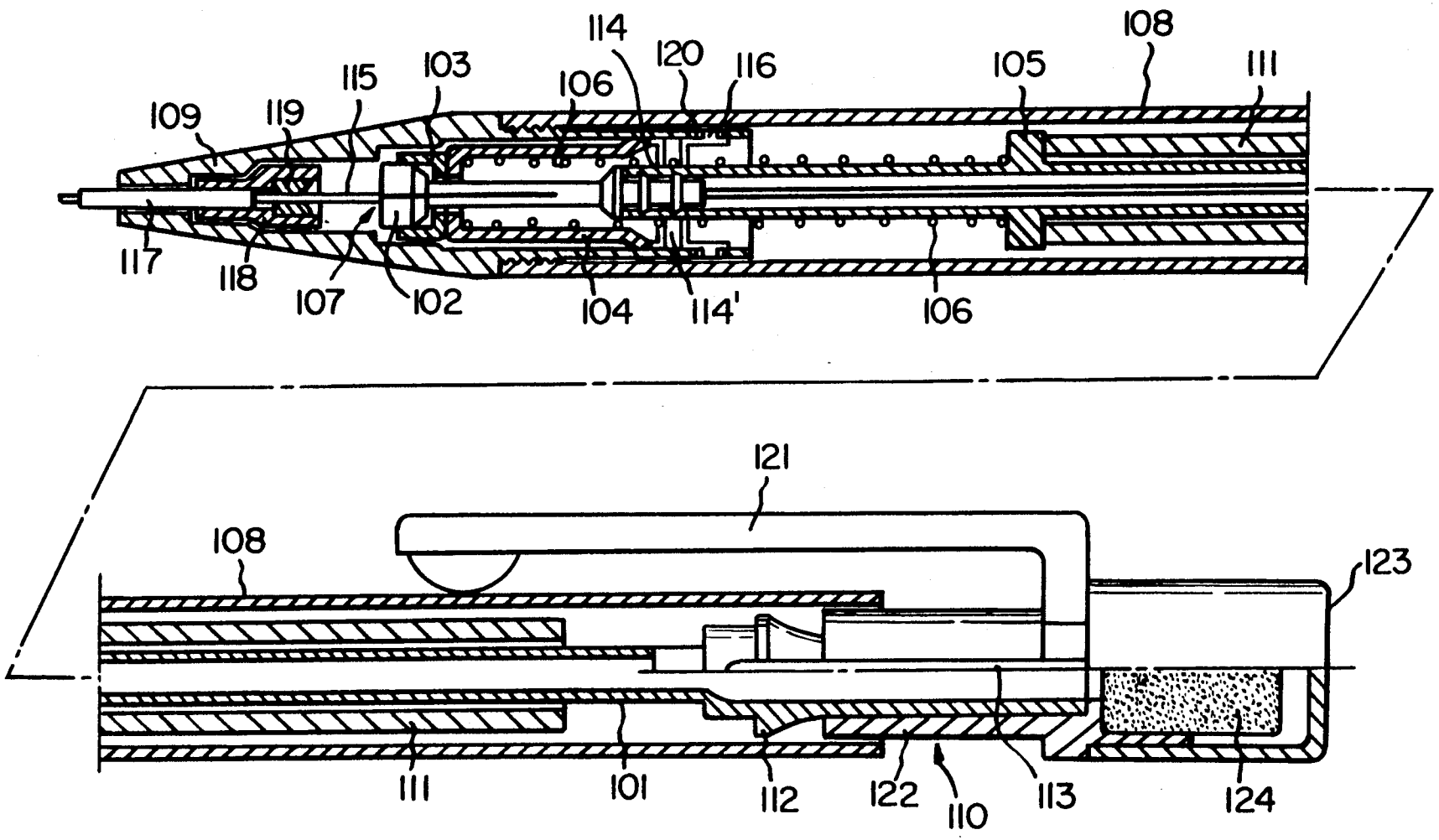
FIG. 4 is a longitudinal sectional view showing a third embodiment.

FIG. 4 is a longitudinal sectional view showing a third embodiment.

In the third embodiment, brim-shaped receiving part 105 and truncated cone-shaped receiving part 112 are provided at the forward end, and the rear part respectively integral with lead pipe 101. Also in a part of lead pipe 101 provided with receiving part 112 of knocking hammer 111, a longitudinal split is provided. In order to insert knocking hammer 111, from the rear end side of lead pipe 101, knocking hammer 111 is pressed against truncated conic surface of receiving part 112. Further, knocking hammer 111 is gradually inserted along the truncated conic surface on the deforming rear part of lead pipe 101, displacing receiving part 112, and is inserted in the area of the lead pipe between both receiving parts 105, 112.

In this case, the longitudinal split 113 provided in lead pipe 101, allows lead pipe 101 to be easily deformed. Therefore. insertion of knocking hammer 111 can be easily accomplished. Further, when the internal diameter of the area of knocking part 110 has a diameter which is a little smaller than the external diameter of lead pipe 101, attachment of knocking part 110 to lead pipe 101 can be positively performed.

As above-mentioned, the travelling scope of knocking hammer 111 is determined with receiving part 105 and knocking part 110 serving also as the receiving part of receiving part 112. Therefore, the number of necessary parts can be reduced to one or two parts. The construction thereby is simple, assembly is easy, and is low-priced.

Figure 5:
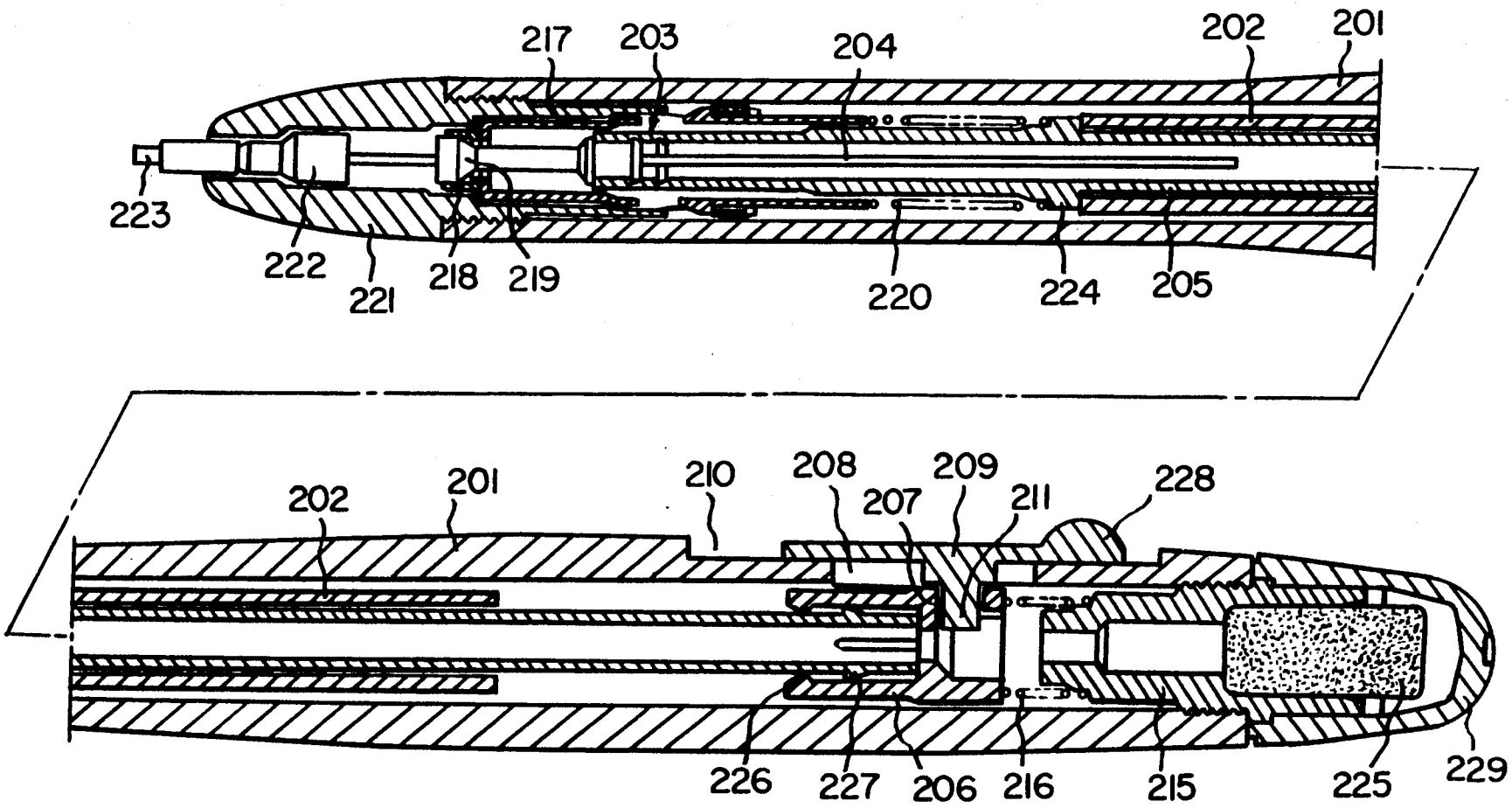
FIG. 5 is a longitudinal sectional view showing a fourth embodiment of a swing-type mechanical pencil.

FIG. 5 is a longitudinal sectional view showing the fourth embodiment of a swing-type mechanical pencil according to the invention.

Figure 7:
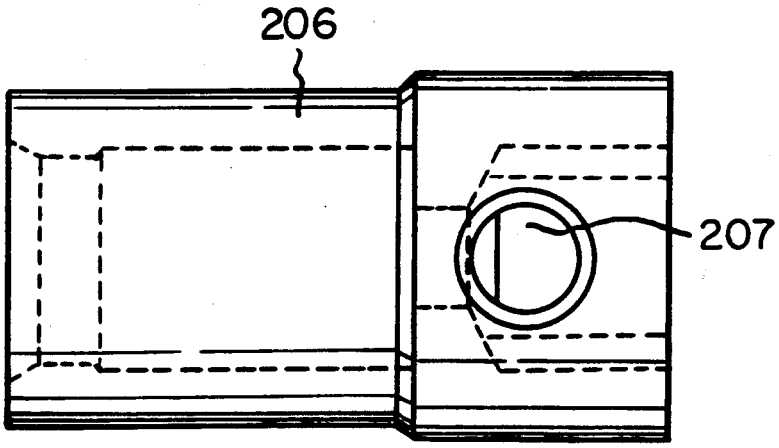
FIG. 7 is a side view showing the lead case bearing of the fourth embodiment.

FIG. 6 is a side view showing a portion of the outer sleeve of this embodiment, FIG. 7 is a side view showing the lead case bearing in this embodiment.

In FIG. 5, outer sleeve 201, has head 221 screwed on the outer sleeve, and guide 222 positioned in head 221 from the top side, with head end pipe 223 appearing and disappearing out of guide 222. Lead-feeding mechanism 203 is inserted in outer sleeve 201 for ex&ending lead 204 out of head pipe 223.

The lead-feeding mechanism 203 comprises a lead case 205, chuck 219 fixed to the forward portion of lead case 203, chuck ring 218 retained on head 221, a chuck-clamping spring 220 inserted between the rear end portion of sleeve 217 and portion 224 used as a spring bearing for lead case 205 and a projecting part. The forward and rearward sides of chuck ring bearing sleeve 217 are connected to the head member through a buffering part (not shown).

Lead case bearing 206, is connected to lead case 205 so that it can be displaced in the axial direction by projecting part 226 provided at the forward inner surface of lead case bearing 206 and clinching part 227 provided at the backward outer surface of lead case 205. Hole 207 is provided in a side portion of lead case bearing 206 (refer to FIG. 7), while axial slit 208 is provided in the area of the outer sleeve, facing hole 207. Knocking hammer 202 is put on lead case 205 between lead case bearing 206 and projection portion 224 used as a spring bearing.

A long hole 210 in which slider 209 can slide, is formed in a part of outer sleeve 201 surrounding slit 208. Projecting part 211 is inserted in hole 207 through slit 208. Slit 208 is formed with a neck portion 212 which causes projecting part 211 to travel step by step, as slider 209 slides backward (refer to FIG. 6). Projecting part 211 of slider 209 engages neck portion 212 at the rear end of slit 208 in the above-mentioned sliding operation so that the slider is locked. Control 228 is provided on slider 209.

Eraser holder 215 is screwed in the rear portion of the outer sleeve. Spring 216 is inserted between eraser holder 215 and lead case bearing 206. Eraser 225 is held in eraser holder 215, covered by cap 229.

In the above-mentioned construction, when outer sleeve 210 is swung, knocking hammer 202 moves up and down between portion 224 used as a spring bearing and a projecting part. Lead case 205 of lead-feeding mechanism 203 is knocked by knocking hammer 202 and moves downward. This knocking action makes chuck 219, inserted in chuck ring 218 and retained in the forward portion of chuck ring bearing sleeve 217 at the forward end portion of lead case 5, move against or with the spring force of chuck-clamping spring 220 and thereby opens or shut so that lead 204 can be extended by a given length from head pipe 223 of guide 222 in the forward end portion of head 221 which is attached to outer sleeve 201.

In this case, since projecting part 211 of slider 209 engages in hole 207 formed in lead case bearing 206 connected with lead case 205, slider 209 is retained in neck portion 212, and upward movement of knocking hammer 202 is restrained.

Further, when slider 209 moves forward and backward along slit 208, lead 204 is extended from head pipe 223 by pushing lead case 205 of lead-feeding mechanism 203 through lead case bearing 206, since projecting part 211 of slider 209 is engages in hole 207 of lead case bearing 206.

In order to withdraw lead 204, lead case 205 is pushed through lead case bearing 206 having hole 207, receiving projecting part 211 of slider 209 by moving forward so that chuck 291 of lead-feeding mechanism 203 can be kept in an open state and lead can be drawn into the head end of outer sleeve 201 by pushing on the tip of lead while keeping the pencil open, in the same manner as for know mechanical pencils.

When carrying the mechanical pencil, projecting part 211 of slider 209 engages neck portion 212 at the rear end of slit 208 by pushing slider 209 backward to compulsorily cause slider 209 to pass through neck portion 212 provided in slit 208 so that the slider is locked. Lead case bearing 206 has projecting part 211 of slider 209 engaging hole 207 and lead case 205 connected thereto is locked by locking of slider 209. Therefore, though the upward and downward movement of outer sleeve 201 makes knocking hammer 203 move up and down, and the lead-feeding action of lead-feeding mechanism 203 cannot occur.

Further, in the above example, since spring 216 is inserted between lead case bearing 206 and eraser holder 215 as shown in FIG. 5, lead case bearing 206 cannot be unsteady. Erasing can be done with eraser 225 by removing cap 220.

Figure 8:
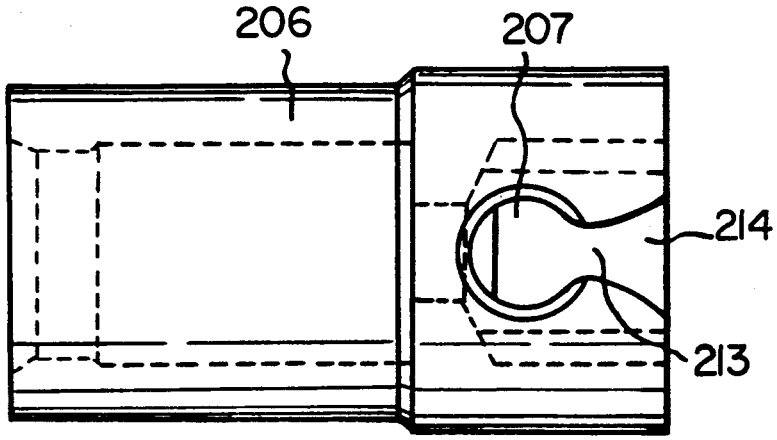
FIG. 8 is aside view showing a fifth embodiment of the lead case bearing of the present invention.

FIG. 8 is a side view showing a fifth embodiment of the lead case bearing of the present invention. In this example, an opened slit 214 reaching to the periphery is formed at the rear portion of hole 207 of lead case bearing 206 through neck portion 213. Therefore, after head member 221 has been unscrewed from the outer sleeve, and pulled out, the lead-feeding mechanism attached thereto, and lead case bearing 206 connected to the lead case of mechanism 203 can be taken out from opened slit 214 without breaking down projecting part 211 of slider 209. As projecting part 211 of slider 209 is inserted in hole 207 through opened slit 214 and neck portion 213, insertion of projecting part 211 into hole 213 can be more easily performed.

As is clear from the above explanation, according to the device, the upward movement of knocking hammer 202 can be restrained without use of another retaining part for restraining upward movement. Besides, particularly when carrying the mechanical pencil projecting part 211 of slider 209 is engaged between neck portion 212 and the rear end of slit 208 by pushing slider 209 backward compulsorily passing through neck portion 212 provided in slit 208 so that the slider is locked. Thereby lead case bearing 206 receiving projecting part 211 of slider 209 in hole 207 and lead case 205 connected thereto are locked by locking slider 209. Therefore, though the upward and downward movement of outer sleeve 201 makes knocking hammer 203 move up and down, the lead-feeding action by lead-feeding mechanism 203 cannot be accomplished.

Figure 9A:
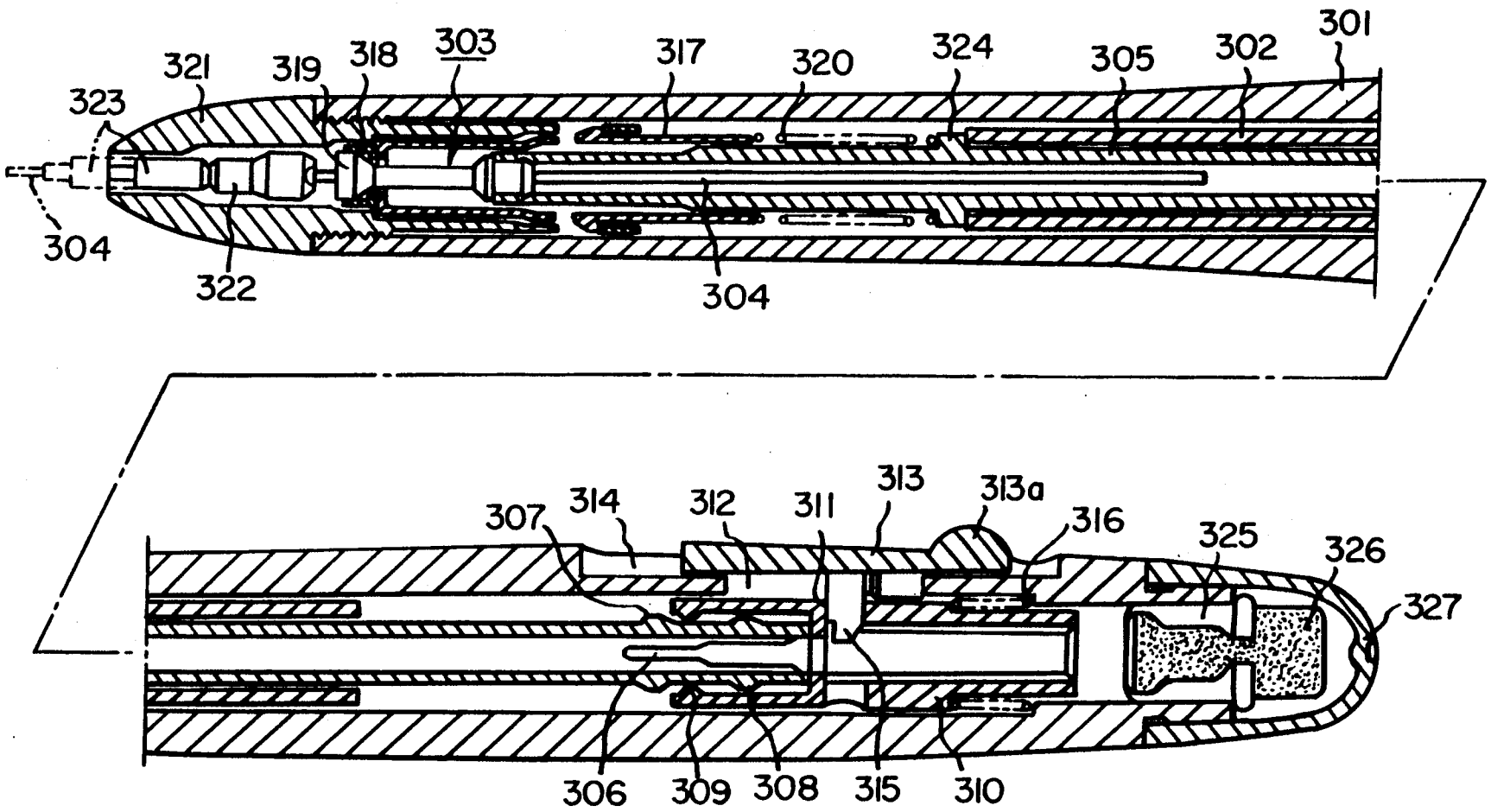
FIGS. 9(*a*) (*b*) are a longitudinal sectional view and a side view of the sixth embodiment respectively.
Figure 9B:
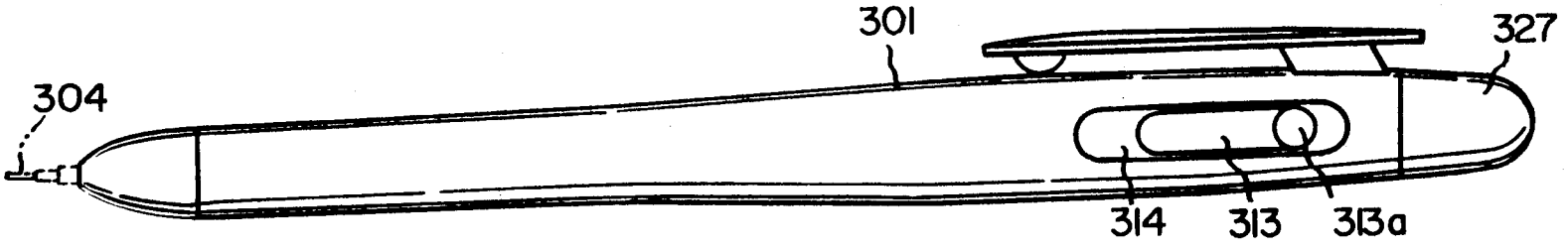
Figure 10A:
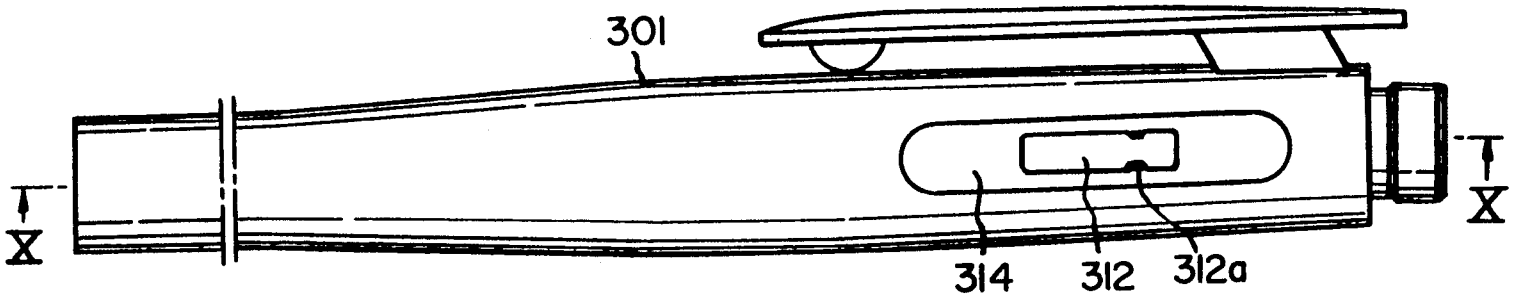
FIGS. 10(*a*) (*b*) are a side view and a sectional view taken on line x—x of an instance of an outer sleeve of the sixth embodiment in the present invention, respectively.
Figure 10B:
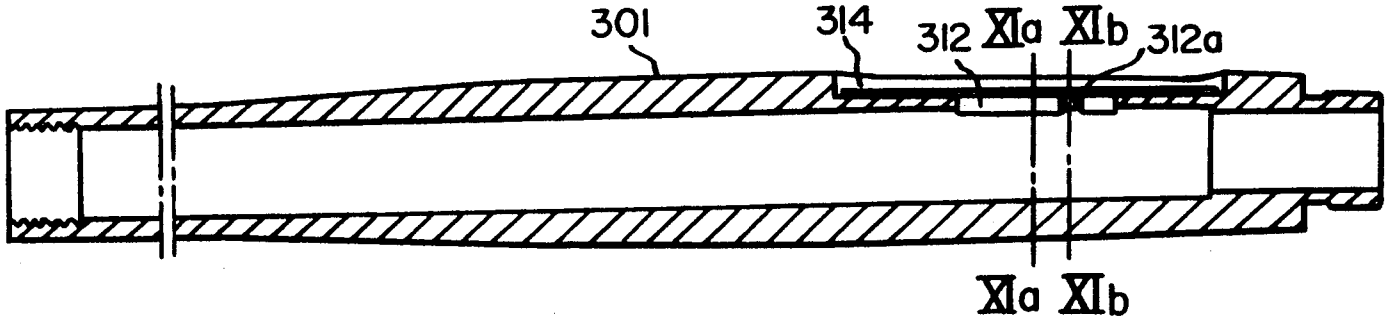

FIGS. 9(*a*), and 9(*b*) are a longitudinal sectional view and a side view, respectively, of a sixth embodiment of a swing-type mechanical pencil according to the invention respectively, and FIGS. 10(*a*), and 10(*b*) are a side view and a sectional view taken on line x—x of an outer sleeve of the present invention.

In FIG. 9, outer sleeve 301, receives a head member screwed on the outer sleeve 301. Guide 322 is screwed on head member 321 on its top side, and head pipe 323 appears and disappear out of head member 321. Lead-feeding mechanism 303 is inserted in outer sleeve 301 for extending lead 304 out of head pipe 323.

Figure 16:
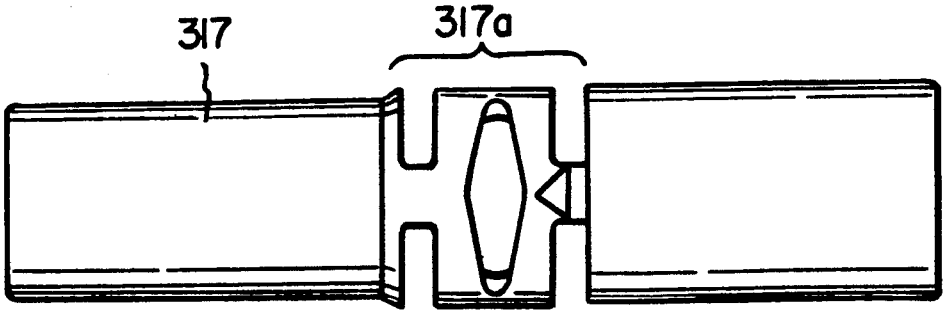
FIG. 16 is a front elevation of the chuck ring bearing sleeve of the sixth embodiment of the present invention.

This lead-feeding mechanism 303 comprises lead case 305, chuck 319 fixed to the forward portion of lead case 305, chuck ring 318 inserted in chuck 319, and a chuck ring bearing sleeve 317 brought into contact with the rear end of chuck ring 318 retained to head member 321. Chuck-clamping spring 320 is inserted between the rear end portion of sleeve 317 and a portion 324 used as a spring bearing for lead case 305 and a projecting part. The forward and rearward sides of chuck ring bearing sleeve 317 are connected to the head member through buffering part 317*a* (refer to FIG. 16).

Figure 12:
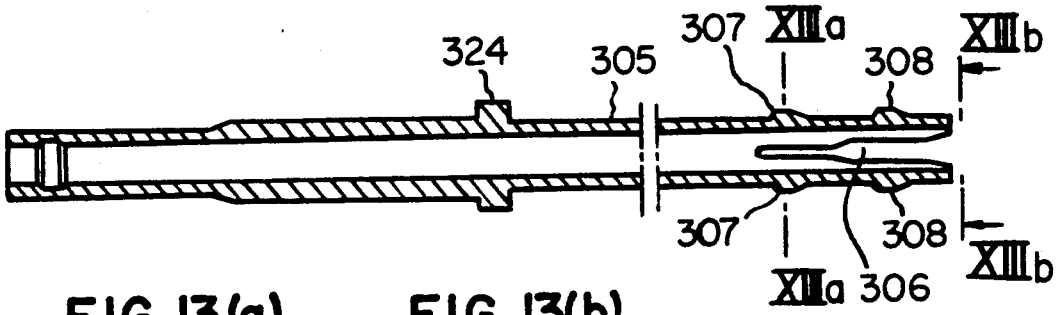
FIG. 12 is a longitudinal sectional view of a lead case of the present invention.
Figure 13A:
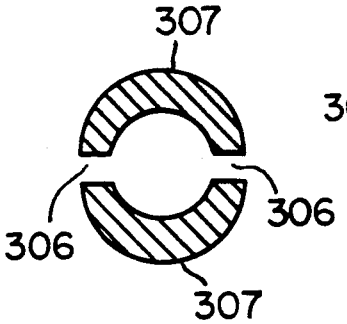
FIGS. 13(*a*) (*b*) are a sectional view taken on line XIIIa—XIIIa and a view taken on line XIIIb—XIIIb respectively.
Figure 13B:
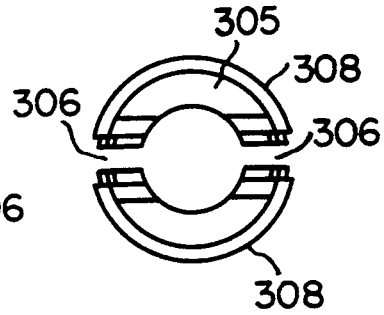

Lead case 305 has axial slits 306 at the rear portion thereof on case side (refer to FIGS. 12 and 13) facing each other with struck part 307 (refer to FIGS. 2, and 13(*a*)) facing each other and with clinching part 308 (refer to FIGS. 12 and 13(*b*) facing each other. The rear portion of the lead case, lead case bearing 310 (refer to FIG. 14), has projection 309 at the inner surface of the forward part between struck part 307 and clinching part 308, connected. Knocking hammer 302 is inserted between struck part 307 and portion 324 used as a spring bearing of the lead case and a projection part.

Figure 11A:
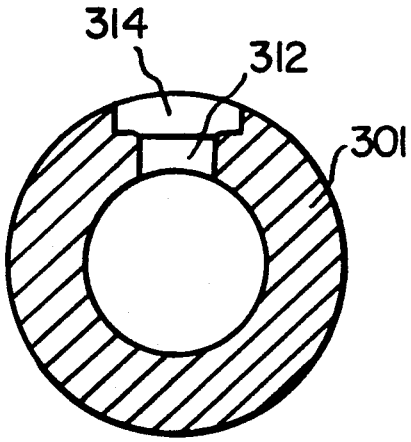
FIGS. 11(*a*) (*b*) are sectional views taken on line XIa—XIa and line XIb—XIb of FIG. 10(*b*), respectively.
Figure 11B:
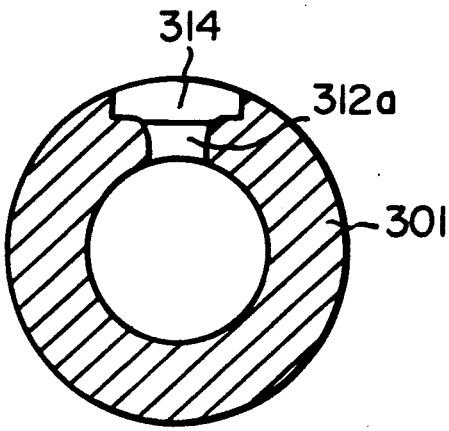
Figure 14C:
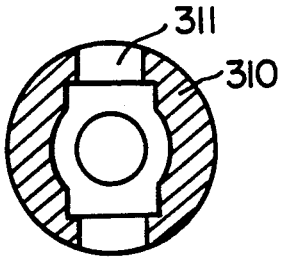
FIGS. 14(*a*)-(*c*) are a longitudinal sectional view, a sectional view taken on line XIVb—XIVb of FIG. 14(*a*), and sectional view taken on line XIVc—XIVc of FIG. 14(*b*) of the lead case bearing, respectively.
Figure 14A:
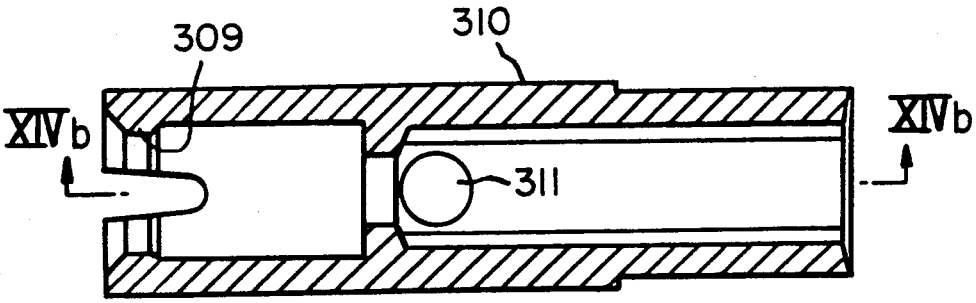
Figure 14B:
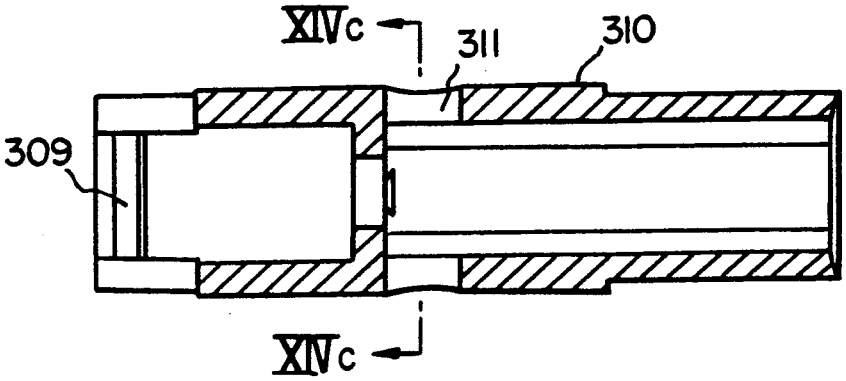
Figure 15A:
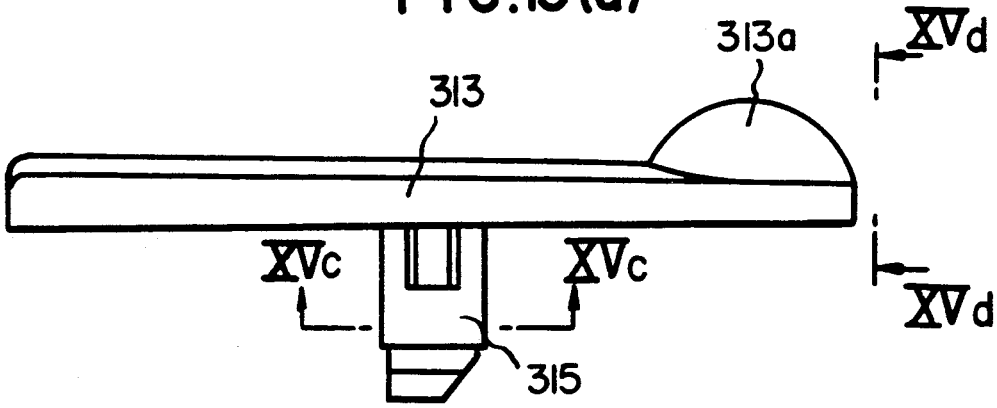
FIGS. 15(*a*)-(*d*) are a side view, bottom view, a sectional view taken on XVc—XVc of FIG. 15(*a*), and a view taken on line XVd—XVd of FIG. 15(*a*) respectively.
Figure 15B:
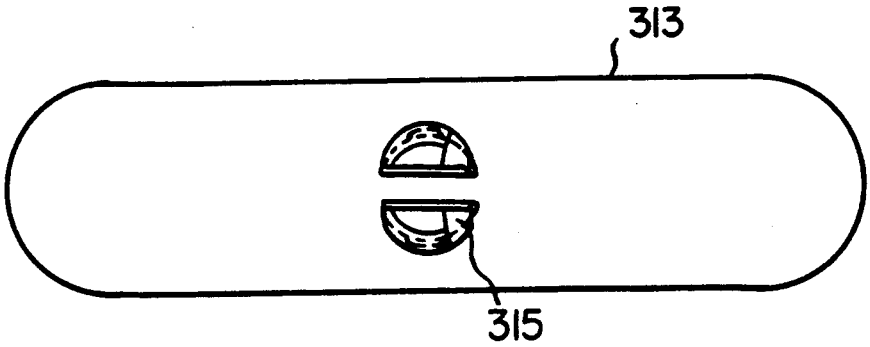
Figure 15C:
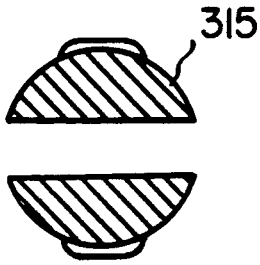
Figure 15D:
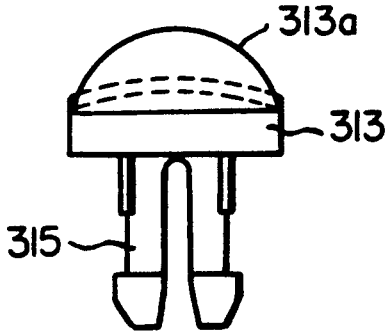

Hole 311 is provided in a side portion of the backward outer surface of lead case bearing 310 (refer to FIG. 14, while an axial lit on the outer sleeve side faces hole 311 (refer to FIG. 10). Long hole 314 in which slider 313 can slide is formed in a part of outer sleeve 301 surrounding the slit 312 on outer sleeve side. Projecting part 315 engages hole 811 through the slit 312 on outer sleeve side 301. The slit 312 on outer sleeve 301 is formed with neck portion 312*a* which makes projecting part 315 travel step by step, as the slider is slid backward (refer to FIGS. 10 and 11). Projecting part 315 of slider 313 engages neck portion 312*a* at the rear end of slit 312 in the above-mentioned sliding operation so that the slider can be locked. Numeral 313*a* designates a control provided on slider 313. Further when slider 313 is slid backward, projection 309 of lead case bearing 310 is brought into contact with clinching part 308 of the lead case.

Eraser jacket 325 is inserted in the rear portion of outer sleeve 301. Eraser jacket 325, receives eraser 326 and is covered by an eraser cover. Spring 316 is inserted between an inner step of the rear portion of outer sleeve 301 and an outer step of the case bearing.

In the above-mentioned construction, when outer sleeve 301 is swung, knocking hammer 302 moves up and down between portion 324 used as a spring bearing and projecting part. Lead case 305 of lead-feeding mechanism 303 is knocked by knocking hammer 302 and moves downward. This knocking action makes chuck 319, inserted in chuck ring 318 retained in the forward portion of chuck ring bearing sleeve 317 held at the forward end portion of lead case 305, move against or with the spring force of chuck-clamping spring 320 and thereby opens or shuts so that lead 304 can be extended by a given length from head pipe 323 of guide 322 in the forward end portion of head member 321 attached to outer sleeve 301.

In order that the extension of lead is smoothly and positively performed by knocking hammer 302, the spring force of chuck-clamping spring 320 is weakened. The weak spring force makes it impossible for chuck 319 to be sufficiently inserted in chuck ring 318 and shut. As a result, there is a possibility of lead slipping while writing with the pencil.

In the present device, struck part 307 is knocked by upwards moving knocking hammer 302 so that lead case 305 is moved upwards a little until slider 313, with projecting part 315 inserted in hole 311 of lead case bearing 310 connected to lead case 305, is retained. As a result, chuck 319 compulsorily engages chuck ring 318 and is shut, which results in positively gripping lead 304 and preventing lead from slipping when writing.

Further, when slider 313 moves forward and backward along the slit on outer sleeve side 312, lead 304 is extended from head pipe 323 by pushing lead cane 305 of lead-feeding mechanism 303 through lead case bearing 310 with the forward and backward movement of slider 313 in the above-mentioned way, since projecting part 315 of slider 313 engages in hole 311 of lead case bearing 310.

In order to draw lead 304 in, lead case 305 is pushed through lead case bearing 310 having projecting part 315 of slider 313 engaging hole 311 to move forward so that chuck 319 of lead-feeding mechanism 303 can be kept in an opened state thereof. Lead can then be drawn into the head end of the outer sleeve by pushing on the tip of lead while keeping an opened state in the same manner as in known mechanical pencils.

While carrying the mechanical pencil, projecting part 315 of slider 313 engages neck portion 312*a* at the rear end of the slit on outer sleeve side 312 by pushing slider 313 backward to compulsorily pass through neck portion 312*a* provided in the slit on outer sleeve side 312 so that slider 313 is locked. Thereby lead case bearing 310 receiving projecting part 315 of slider 313 in hole 311 and lead case 305 connected thereto are locked with slider 313. Therefore, though the upward and downward movement of outer sleeve 301 makes knocking hammer 303 move up and down, the lead-feeding action by lead-feeding mechanism 303 cannot occur.

Further, in the example, since spring 316 is inserted between an inner step of the rear portion of outer sleeve 301 and an outer step of lead case bearing 310 as shown in FIG. 9, lead case bearing 310 is steady. Erasing can be done with eraser 326 after removing eraser cover 320.

Lead can be supplied from the rear end of outer sleeve 301 by removing eraser cover 327 and eraser jacket 325.

As is clear from the above-explanation, according to the device struck part 307 is knocked by upward moving knocking hammer 302 so that lead case 305 moves upward until slider 313 having projecting part 315 engaging in hole 311 of lead case bearing 310 connected to lead case 305 is retained. As a result, chuck 319 compulsorily engages in chuck ring 318 and shuts, which results in positively gripping lead 304 preventing lead from slipping while writing. At the time of carrying the mechanical pencil, projecting part 315 of slider 313 engages neck portion 312*a* and the rear end of the slit on outer sleeve side 312 by pushing slider 313 backward and compulsorily engaging and passing through neck portion 312*a* provided in the slit on outer sleeve side 312 so that slider 313 is locked. Thereby lead case bearing 310 having projecting part 315 of slider 313 engaging hole 311 and lead case 305 connected thereto are locked with slider 313. Therefore, though the upward and downward movement of outer sleeve 301 makes knocking hammer 303 move up and down, the lead-feeding action by lead-feeding mechanism 303 cannot occur.

This invention is not to be limited by the embodiment shown in the drawings and described in the description, which is given by way of example and not of limitation, but only in accordance with the scope of the appended claims.

We claim:

1. In a swing type mechanical pencil in which lead is extended out the head end of an outer sleeve from a lead feeding mechanism by the action of a knocking hammer by swinging said mechanical pencil by said outer sleeve, the improvement comprising; a lead case; a lead case bearing engaging a rearward portion of said lead case; a clinching part formed on the rearward portion of said lead case; said lead case bearing having an interference fit with said clinching part on said lead case such that said lead case bearing is retained on the end of said lead case; slider means slidably mounted on said outer sleeve for sliding said lead case into a locked position preventing movement; an elongate slit means on opposite sides of the rearward end of said lead case; hammer abutment means on the rearward end of said lead case circumjacent said elongate slit means; spring bearing projecting abutment means on a forward portion of said lead case for retaining a biasing spring between said lead case and said outer sleeve; said hammer sliding over the end of said lead case and said hammer abutment; said hammer being retained on said lead case between said hammer abutment and spring bearing projecting abutment; whereby said hammer is prevented from coming off said lead container.

2. The swing-type mechanical pencil according to claim 1 in which said interference fit is formed between a raised peripheral portion on a forward end of said lead case bearing and said clinching part to retain said lead case bearing on said lead case.

3. The swing-type mechanical pencil according to claim 1 in which said hammer abutment means and said spring bearing projecting abutment are integrally formed on said lead case.

4. The swing-type mechanical pencil according to claim 2 including; a through hole in a side of said lead case bearing; a projection on said slider extending into said hole in said lead case bearing; a narrowing neck portion in said outer sleeve; said narrowing neck portion constructed to receive and retain said projection against movement, said slider and lead case being locked against movement when said projecting part is in said narrowing neck portion; whereby said slider may slide forward to manually advance said lead or slide backward to lock said slider to prevent lead from being extended by the knocking action of said hammer on said lead feeder.

5. The swing-type mechanical pencil according to claim 2 in which said lead case bearing has a longitudinal opening whereby said lead case bearing will engage and slip over the end of said lead case with said lead case bearing projection passing over said lead case clinching projection.

* * * * *